US011737542B2

(12) United States Patent
Kim

(10) Patent No.: US 11,737,542 B2
(45) Date of Patent: Aug. 29, 2023

(54) NAIL CLIPPER

(71) Applicant: ROYAL METAL INDUSTRIAL CO., LTD, Bucheon-si (KR)

(72) Inventor: Gab-Soo Kim, Bucheon-si (KR)

(73) Assignee: ROYAL METAL INDUSTRIAL CO., LTD, Bucheon-si (KR)

( * ) Notice: Subject to any disclaimer, the term of this patent is extended or adjusted under 35 U.S.C. 154(b) by 0 days.

(21) Appl. No.: 17/170,738

(22) Filed: Feb. 8, 2021

(65) Prior Publication Data

US 2021/0274908 A1 Sep. 9, 2021

(51) Int. Cl.
*A45D 29/02* (2006.01)

(52) U.S. Cl.
CPC ..... *A45D 29/02* (2013.01); *A45D 2029/026* (2013.01)

(58) Field of Classification Search
None
See application file for complete search history.

(56) References Cited

U.S. PATENT DOCUMENTS

| | | | | |
|---|---|---|---|---|
| 2,664,624 A * | 1/1954 | Bassett | A45D 29/02 30/28 |
| 7,913,391 B1 * | 3/2011 | Eul | A45D 29/02 30/28 |
| 2021/0274908 A1 * | 9/2021 | Kim | A45D 29/02 |

FOREIGN PATENT DOCUMENTS

| | | |
|---|---|---|
| CN | 112189975 A * | 1/2021 |
| KR | 2020000021546 U | 12/2000 |
| KR | 10-0479827 | 6/2005 |
| KR | 10-0497063 | 6/2005 |
| KR | 2020080000640 U | 4/2008 |
| KR | 10-0866365 | 10/2008 |
| KR | 1020120017509 A | 2/2012 |
| KR | 10-1143904 | 5/2012 |
| KR | 10-1350392 | 1/2014 |
| KR | 101845380 B1 | 3/2018 |
| KR | 10-2020882 | 9/2019 |

OTHER PUBLICATIONS

Notice of Allowance issued by the Korean Intellectual Property Office in connection with Application No. KR 10-2020-0026959 dated Sep. 3, 2021.

Office Action issued by the Korean Intellectual Property Office in connection with Application No. KR 10-2020-0026959 dated Mar. 4, 2020.

* cited by examiner

*Primary Examiner* — Hwei-Siu C Payer
(74) *Attorney, Agent, or Firm* — Dennemeyer & Associates LLC

(57) ABSTRACT

Proposed is a nail clipper configured to cut fingernails or toenails using the engagement of upper and lower blades. In a section opposite to the cutting blades, a portion of an upper elastic plate is stacked on a portion of a lower plate. In a position forward of the section, a concave portion is provided in a bottom surface of the upper elastic plate. When the cutting blade of the upper elastic plate and the cutting blade of the lower plate are brought into engagement with each other, the blade of the upper elastic plate is located inside of the blade of the lower plate. A stepped portion is provided in an inner portion of an inclined portion of the front end of each of the upper elastic plate and the lower plate. The cutting blades have a minute distance therebetween. The cutting performance and durability of the nail clipper are improved.

3 Claims, 11 Drawing Sheets

NAIL CLIPPER

CROSS REFERENCE TO RELATED APPLICATION

The present application claims priority to Korean Patent Application No. 10-2020-026959, filed Mar. 4, 2020, the entire contents of which is incorporated herein for all purposes by this reference.

BACKGROUND OF THE INVENTION

Field of the Invention

The present disclosure relates generally to a nail clipper configured to cut fingernails or toenails using the engagement of upper and lower blades. More particularly, the present disclosure relates to a nail clipper having a structure in which the shape of an upper elastic plate of a body or the angles of cutting blades are improved and the cutting blades have a minute distance therebetween, such that cutting performance and durability may be improved.

Description of the Related Art

A nail clipper widely in use is one of essential hygiene tools of modern people. The Nail clipper is used to cut fingernails or toenails which continuously grow.

A typical nail clipper is configured such that a fingernail is pushed between cutting blades and a pressing plate is pressed so that the fingernail is cut under the pressure between the upper and lower plates. Such a nail clipper is fabricated by machining an elastic metal plate in a variety of methods, such as press machining. Here, a pressing plate, to which the principle of a lever is applied, is mounted to a body.

When a large amount of force is applied in the cutting of fingernails, the upper blade and the lower blade may strongly press against each other, thereby being damaged. In order to prevent cutting performance from being significantly lowered, the angles of the cutting blades are required to be small, so that nails may be cut with only a small amount of force.

A Nail clipper known to date is fabricated such that the angles of the cutting blades are about 45°. Thus, even though the cutting blades are sharply polished, cutting power is low. However, it is difficult to machine the cutting blades at angles of 45° or smaller according to the existing structure of the nail clipper.

Korean Patent No. 10-0479827 discloses a technology related to such a nail clipper. Referring to Korean Patent No. 10-0479827, pieces of fingernails or toenails cut in a process of operating upper and lower blades about a hinge pin by operating upper and lower plates by pressing a pressing plate are collected in a collection box.

However, since the top end of the upper plate becomes planar at the moment that the hinge pin fixed to the pressing plate presses the upper plate, the distance between the upper blade and the lower blade is small. Thus, it is difficult to use the nail clipper when a user has thick fingernails or toenails.

In addition, a nail clipper disclosed in Korean Patent No. 10-0866365 is configured such that a support rod is mounted on upper and lower elastic plates respectively having cutting blades to hold the front end of a pressing plate, the upper and lower elastic plates and the pressing plate are formed relatively thin, and the cross-sectional surfaces thereof are in the shape of arcs. However, such a nail clipper has a problem of increased fabrication costs, since the cross-sectional surfaces of the upper and lower elastic plates must be machined in the shape of arcs.

The foregoing is intended merely to aid in the understanding of the background of the present disclosure, and is not intended to mean that the present disclosure falls within the purview of the related art that is already known to those skilled in the art.

DOCUMENTS OF RELATED ART (Patent Document 1) Korean Patent No. 10-0497063 (registered on Jun. 15, 2005, titled "NAIL CLIPPERS AND NAIL CUTTER, LEVER AND SUPPORTING SHAFT FOR NAIL CLIPPERS")

(Patent Document 2) Korean Patent No. 10-0866365 (registered on Oct. 27, 2008, titled "NAIL CLIPPER")

(Patent Document 3) Korean Patent No. 10-1143904 (registered on May 1, 2012, titled "NAIL CLIPPER WITH DETACHABLE NAIL CUTTER")

(Patent Document 4) Korean Patent No. 10-1350392 (registered on Jan. 6, 2014, titled "NAIL CLIPPER")

(Patent Document 5) Korean Patent No. 10-2020882 (registered on Sep. 5, 2019, titled "NAIL CLIPPERS")

SUMMARY OF THE INVENTION

Accordingly, the present disclosure has been made keeping in mind the above problems occurring in the related art, and the present disclosure is intended to propose a nail clipper having a structure in which a concave portion is formed in an upper elastic plate and the angles of blades are improved, such that the nail clipper may be conveniently used with a very small amount of force.

Also provided is a nail clipper having a structure in which a stepped portion is formed on an inner portion of a distal portion of a blade to reduce the angle of the blade to be close to 30°, so that fingernails may be cleanly cut, thereby significantly improving the cutting performance and durability. Accordingly, a phenomenon in which the blades are damaged during the use of an existing nail clipper may be prevented.

In order to achieve the above objective, according to one aspect of the present disclosure, there is provided a nail clipper including: a body including an upper elastic plate and a lower plate respectively having cutting blades in front ends thereof and holes in positions adjacent to the cutting blades, wherein the upper elastic plate and the lower plate are arranged in a top-bottom direction, and the cutting blades face each other while being spread from each other; a lever including a supporting portion having a coupling hole; and a support pin fitted into the holes of the upper elastic plate and the lower plate, with a catching protrusion thereof being fitted to the coupling hole of the lever, thereby coupling the body and the lever, wherein, in a section opposite to the cutting blades, a portion of the upper elastic plate is stacked on a portion of the lower plate, and a concave portion is provided in a bottom surface of the upper elastic plate in a position forward of the section, when the cutting blade of the upper elastic plate and the cutting blade of the lower plate are brought into engagement with each other, the cutting blade of the upper elastic plate is located inside of the cutting blade of the lower plate with a distance, and a stepped portion is provided in an inner portion of an inclined portion of the front end of each of the upper elastic plate and the lower plate.

The section in which the portion of the upper elastic plate is stacked on the portion of the lower plate may be bound by spot welding or bending. Slots and fine grooves may be provided on opposite sides of a surface of the upper elastic plate. In addition, the inclined portion of each of the upper elastic plate and the lower plate may have an inclination angle ranging from 28° to 32°. When the cutting blades are brought into engagement with each other, the distance between the cutting blades may range from 0.03 mm to 0.07 mm.

The lever may include a stepped portion and a curved portion which are continuous. Fine grooves may be machined in a surface of the lever. A supporting projection may be provided on a rear end of the supporting portion bound to the upper elastic plate. An abrasive member may be buried in a bottom surface of the stepped portion of the lever.

According to the present disclosure, the concave portion of the upper elastic plate is located in the inclined portion located forward of a section in which a portion of the upper elastic plate is stacked on a portion of the lower plate. Accordingly, when the lever is pressed, the function of the nail clipper may be activated with a significantly smaller amount of force than in related-art nail clippers.

In addition, the angles of the cutting blades of the upper elastic plate and the lower plate are improved and the cutting blade of the upper elastic plate is located inside of the cutting blade of the lower plate when the cutting blades are brought into engagement with each other. Accordingly, a phenomenon in which sharp blades may be damaged by being pressed against each other as in the related art may be prevented. In addition, cutting force may be significantly improved to cleanly cut nails, thereby significantly improving cutting performance.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION OF THE INVENTION

Hereinafter, exemplary embodiments of the present disclosure will be described in detail with reference to the accompanying drawings, but specific structures and functions thereof are provided for illustrative purposes only. Therefore, the present disclosure is not limited to the embodiments described herein.

First, as an example to which the present disclosure is applied, Korean Patent No. 1845380, which was previously proposed and filed by the applicant and the technical value of which has been admitted, will be described in detail, and the problems thereof will be deduced. Thereafter, the configurations, functions, and effects of the present disclosure will be described.

Figure 1:
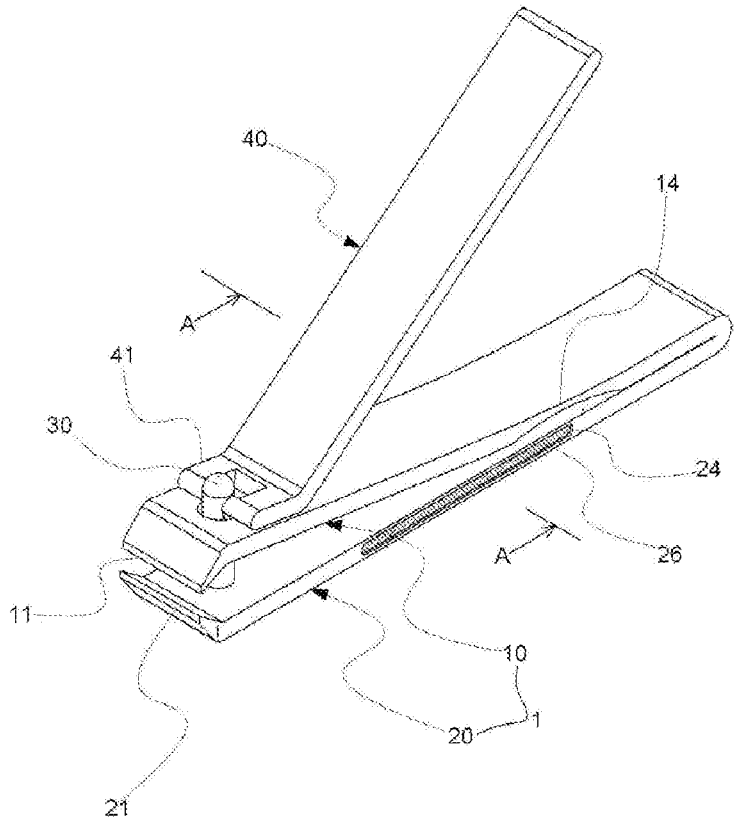
Fig. 1 (PRIOR ART)
FIG. 1 is a perspective view illustrating the overall shape of a nail clipper disclosed in Korean Patent No. 10-1845380.
Figure 2:
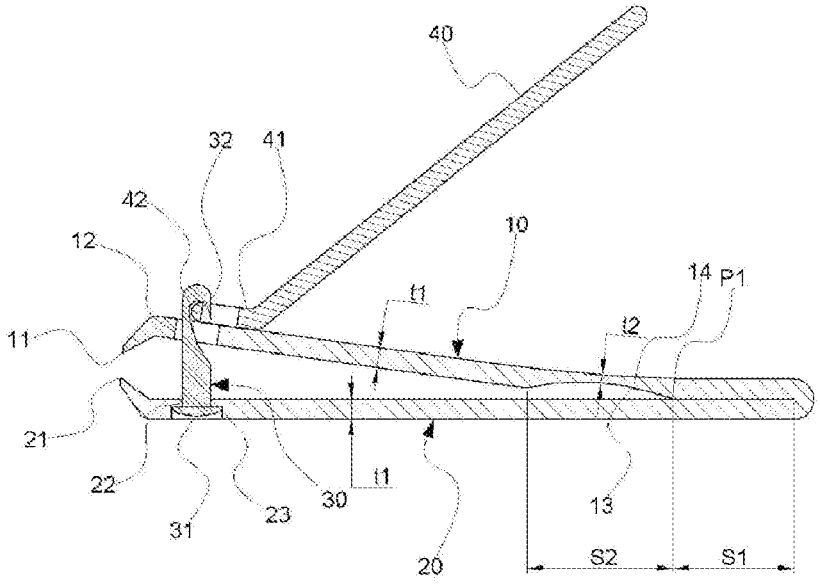
Fig. 2 (PRIOR ART)
FIG. 2 is a side view of the nail clipper illustrated in FIG. 1.
Figure 3:
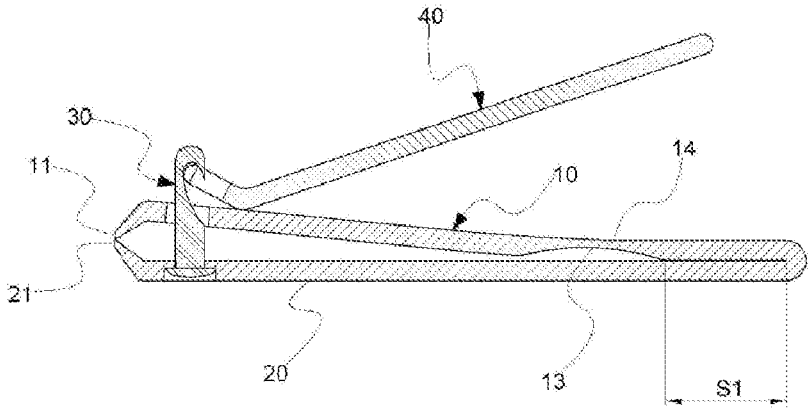
Fig. 3 (PRIOR ART)
FIG. 3 is a side view of the nail clipper of FIG. 1 in a position in which the lever is pressed.

Referring to FIGS. 1 to 3, a body 1 includes an upper elastic plate 10 having a cutting blade 11 and a lower plate 20 having a cutting blade 21. The upper elastic plate 10 and the lower plate 20 are arranged in the top-bottom direction, such that the cutting blade 11 of the upper elastic plate 10 and the cutting blade 21 of the lower plate 20 face each other while being spaced apart from each other when the upper elastic plate 10 and the lower plate 20 are spread.

In addition, the upper elastic plate 10 and the lower plate 20 have holes 12 and 22 formed adjacently to the cutting blades 11 and 21, respectively. A support pin 30 is fitted into the hole 22 of the lower plate 20 and the hole 12 of the upper elastic plate 10, and a coupling portion 42 formed on a fulcrum 41 of a lever 40 is coupled to a catching protrusion 32 of the support pin 30 such that a head 31 of the support pin 30 is caught by the peripheral portion of the hole 22 of the lower plate 20 and the fulcrum 41 of the lever 40 is in tight contact with the upper elastic plate 10.

When the cutting blade 11 of the upper elastic plate 10 and the cutting blade 21 of the lower plate 20 are brought into engagement with each other by the lever 40, unbent portions of the upper elastic plate 10 and the lower plate 20 have thicknesses t1. A concave portion 13 is formed in the upper elastic plate 10 to reduce the elastic force of the upper elastic plate 10. The concave portion 13 forms a thickness-reduced portion 14 in the upper elastic plate 10.

The upper elastic plate 10 is fabricated from steel or stainless steel, with the thickness t1 generally ranging from 2.0 mm to 3.5 mm.

The concave portion 13 is formed in the bottom surface of the upper elastic plate 10 facing the lower plate 20 and starts at a point P1, i.e. a terminal point of a stacked section S1, in which a portion of the upper elastic plate 10 is stacked on a portion of the lower plate 20. The width S2 of the concave portion 13 is determined by the thickness t1 of the upper elastic plate 10 and the minimum thickness t2 of the thickness-reduced portion 14.

The lower plate 20 has a recess 23 around the hole 22, wherein the recess 23 receives the head 31 of the support pin 30.

Figure 4:
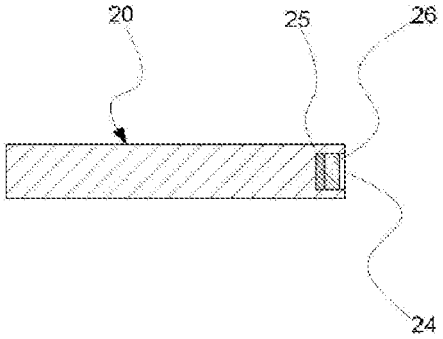
Fig. 4 (PRIOR ART)
FIG. 4 is a cross-sectional view of the lower plate, taken along the line A-A in FIG. 1.

Referring to FIGS. 1 and 4, a long hole 24 is formed in one side surface of the lower plate 20. An abrasive member 26 is inserted into the long hole 24 and fixed by a double-sided tape 25. The abrasive member 26 is used to smoothly finish a cut section of a fingernail or a toenail.

In the nail clipper having the above-described configuration, in a position in which the cutting blade 11 of the upper elastic plate 10 and the cutting blade 21 of the lower plate 20 are spread as illustrated in FIG. 2, when a user presses the lever 40 as illustrated in FIG. 3, the cutting blade 11 of the upper elastic plate 10 and the cutting blade 21 of the lower plate 20 are brought into engagement with each other from the spread position by the lever 40.

Since the thicknesses t1 of the upper elastic plate 10 and the lower plate 20 are enough not to be bent, the upper elastic plate 10 may be prevented from being bent. Consequently, the cutting blade 11 of the upper elastic plate 10 may be prevented from protruding more forward than the cutting blade 21 of the lower plate 20, thereby preventing the tip of the fingernail from being cut roughly.

In addition, since the concave portion 13 is formed in the upper elastic plate 10 and the thickness-reduced portion 14 is formed in the upper elastic plate 10 due to the concave portion 13, the elastic force of the upper elastic plate 10 is reduced. Consequently, the user may cut fingernails by pressing the lever 40 with a small amount of force.

In addition, the head 31 of the support pin 30 does not protrude from the bottom surface of the lower plate 20, thereby providing an aesthetic appearance. The upper elastic plate 10 and the lower plate 20 of the body 1 are provided integrally and the lower plate 20 is folded with respect to the upper elastic plate 10 in a position opposite to the cutting blades 11 and 21, thereby forming the stacked section S1, in which the upper elastic plate 10 is stacked on the lower plate 20.

In the previously granted patent of the applicant, the concave portion formed in the upper elastic plate starts from a point at which the stacked section. Thus, the upper elastic plate moves along a long arc due to the lever, so that the upper blade tends to be pushed more forward than the lower blade.

In addition, when the nail clipper is operated by pressing the lever, the cutting blade of the upper elastic plate and the cutting blade of the lower plate are brought into contact to damage each other, thereby leading to a disadvantageous feature fatal to durability. Due to the feature in which the upper blade tends to be pushed outward with respect to the lower blade, fingernails are not properly cut, which is problematic.

In consideration of the problems occurring in the previous patent, the applicant optimally designed a lever structure including the upper elastic plate, as well as an arrangement of the cutting blades, of the nail clipper, in order to provide the nail clipper that users may conveniently use. The nail clipper according to the present disclosure will be described in detail with reference to FIGS. 5 to 9.

Figure 5:
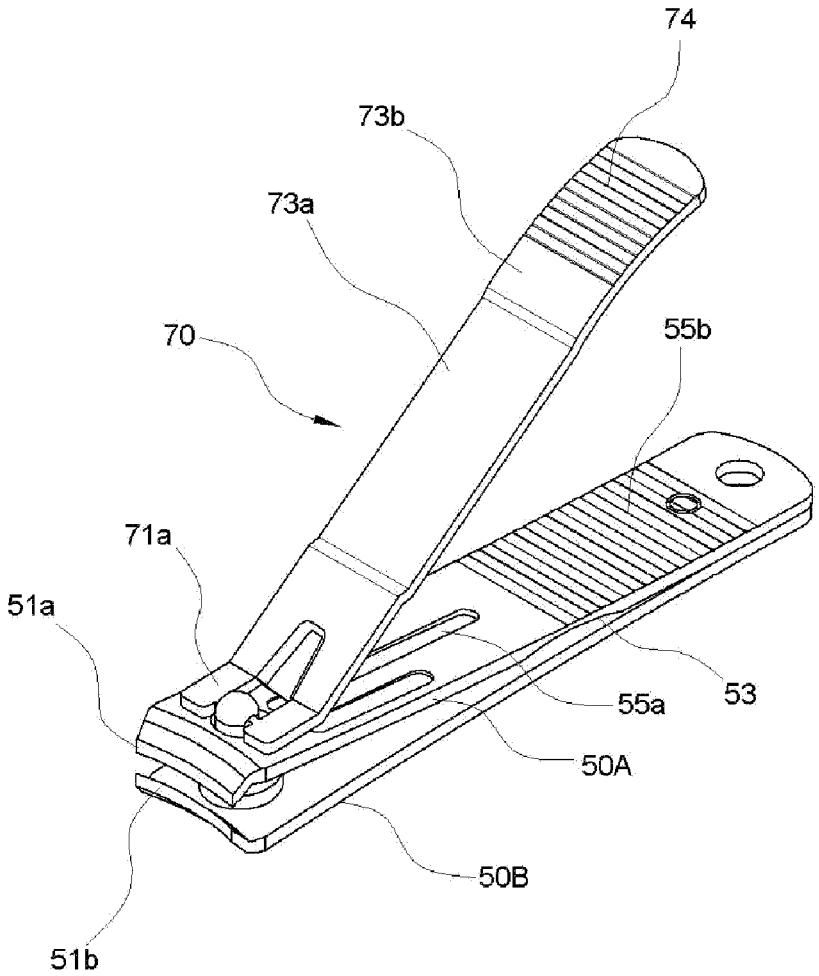
FIG. 5 is a perspective view illustrating an overall shape of a nail clipper according to the present disclosure.
Figure 6:
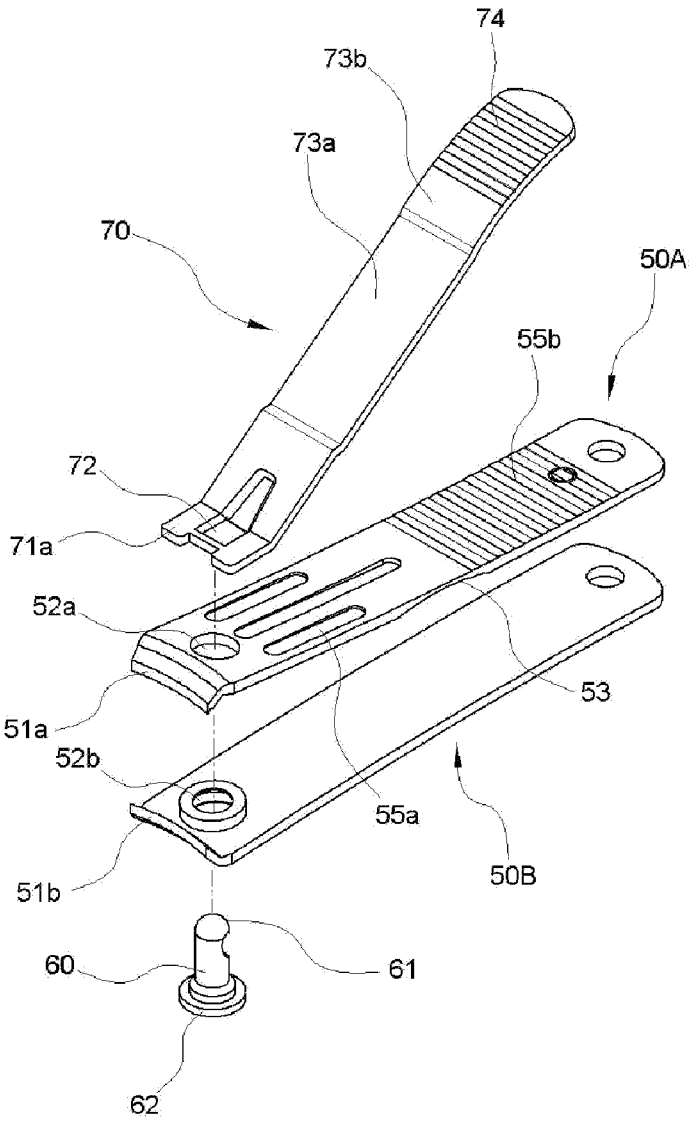
FIG. 6 is an exploded perspective view of the nail clipper illustrated in FIG. 5.

As illustrated in FIGS. 5 and 6, the nail clipper according to the present disclosure includes: a body including an upper elastic plate 50A and a lower plate 50B and a lever 70 mounted on the body via a support pin 60. The lever 70 is used to press the upper elastic plate 50A to cut fingernails.

The upper elastic plate 50A and the lower plate 50B are arranged in the top-bottom direction, such that cutting blades 51*a* and 51*b* formed on leading ends thereof face each other while being spread from each other. The upper elastic plate 50A and the lower plate 50B have holes 52*a* and 52*b* in portions thereof located adjacent to the cutting blades 51*a* and 51*b*, respectively.

The support pin 60 is fitted through the hole 52*b* of the lower plate 50B so as to be bound with the lever 70, in a position adjacent to the hole 52*a* of the upper elastic plate 50A. In a position in which a supporting portion 71*a* and a supporting protrusion 71*b* of the lever 70 are in tight contact with the upper elastic plate 50A, a coupling hole 72 defined by the supporting portion 71*a* is bound with a catching protrusion 61 of the support pin 60.

Figure 7A:
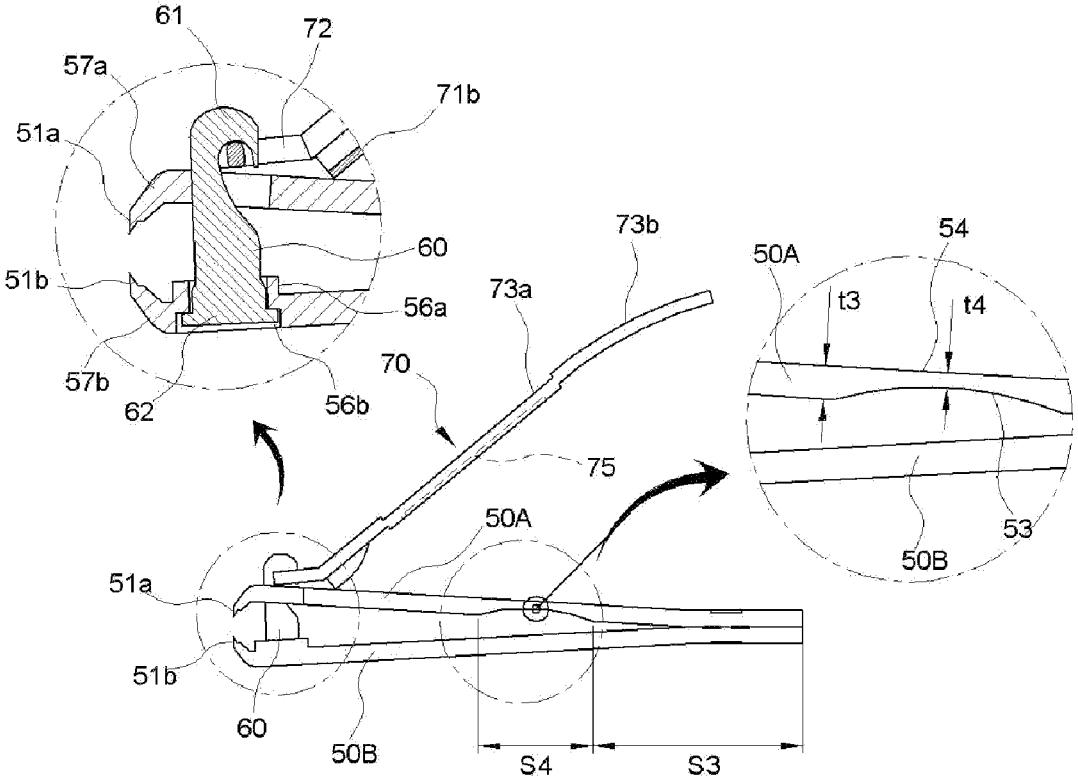
FIGS. 7*a* to 7*c* are side views illustrating operating states of the lever.
Figure 7B:
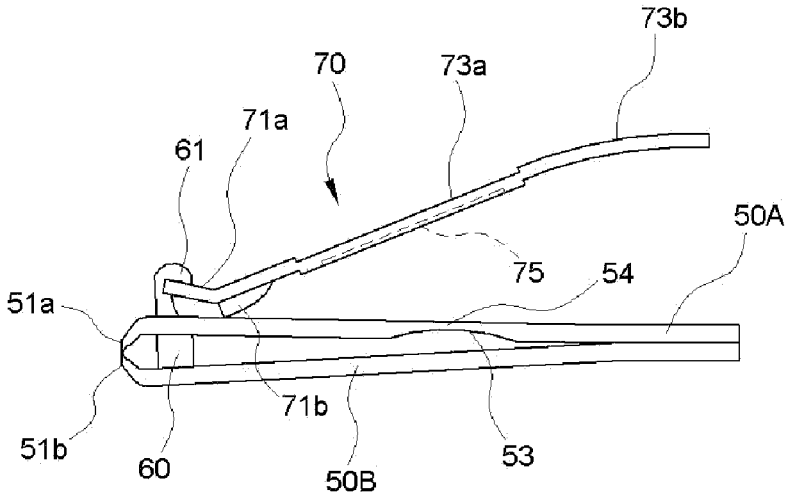
Figure 7C:
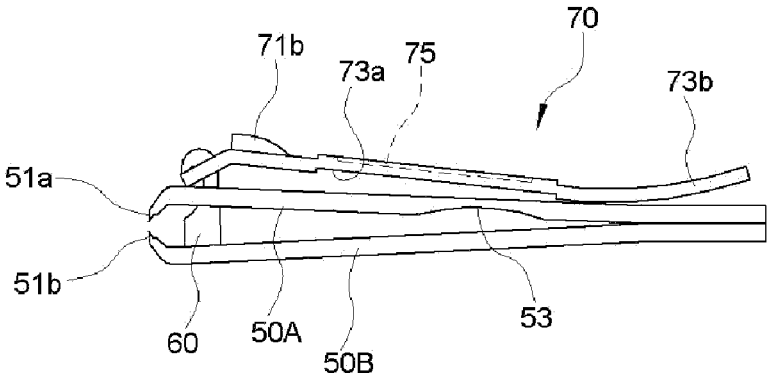

As illustrated in FIGS. 7*a* to 7*c*, when the cutting blades 51*a* and 51*b* of the upper elastic plate 50A and the lower plate 50B are brought into engagement with each other by the lever 70, unbent portions of the upper elastic plate 50A and the lower plate 50B have thicknesses t3. A concave portion 53 is formed in the upper elastic plate 50A to reduce the elastic force of the upper elastic plate 50A. The concave portion 53 forms a thickness-reduced portion 54 in the upper elastic plate 50A.

The concave portion 53 is formed in the bottom surface of the upper elastic plate 50A facing the lower plate 50B. The concave portion 53 is formed in an inclined portion, at a predetermined distance from the front end of a section S3 in which a portion of the upper elastic plate 50A is stacked on a portion of the lower plate 50B. The width S4 and the thickness t4 of the concave portion 53 are determined to be in ranges in which the supporting force of the upper elastic plate 50A is not affected.

Thus, when the lever 70 is pressed, elastic force acts in the front portion of the upper elastic plate 50A due to the concave portion 53 of the upper elastic plate 50A, so that the function of the nail clipper may be activated with a minimum amount of force. In addition, since the concave portion 53 is formed forwardly spaced apart from the section S3, the upper blade may be prevented from being pushed more forward than the lower blade, and a thin material may be used.

The section S3, in which the upper elastic plate 50A is stacked on the lower plate 50B, is bound by spot welding. Slots 55*a* are formed on one side of the top surface of the upper elastic plate 50A and fine grooves 55*b* are formed on the other side of the top surface of the upper elastic plate 50A. A head 62 of the support pin 60 is received in the hole 52*b* of the lower plate 50B.

Here, the hole 52*b* of the lower plate 50B includes a flange 56*a* and a recessed hole 56*b* in order to prevent the head 62 of the support pin 60 from escaping from the hole 52*b* in the top direction. This may remove the inconvenience of users and improve an aesthetic appearance.

Figure 8:
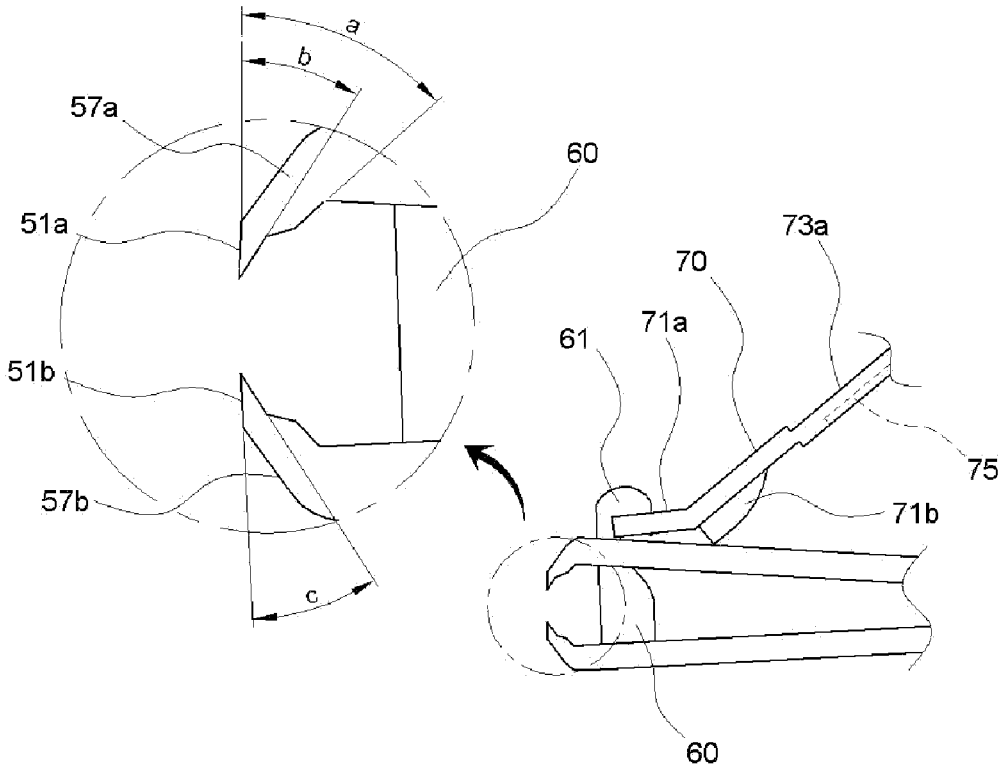
FIGS. 8 and 9 are enlarged views of portions of the nail clipper including the cutting blades.
Figure 9:
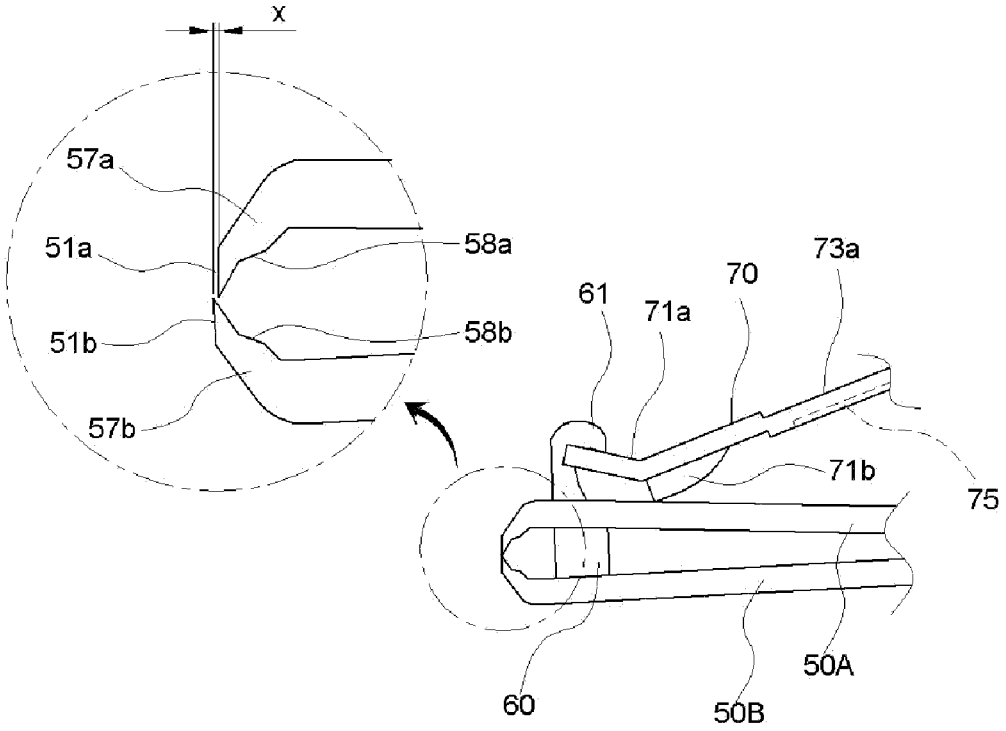

As illustrated in FIGS. 8 and 9, when the cutting blade 51*a* of the upper elastic plate 50A and the cutting blade 51*b* of the lower plate 50B are brought into engagement with each other, the cutting blade 51*a* of the upper elastic plate 50A is located inside with a distance x. Accordingly, a related-art phenomenon in which sharp blades are damaged by being pressed against each other may be prevented. In addition, fingernails may be sharply cut, and thus, the cutting performance may be significantly improved.

That is, stepped portions 58*a* and 58*b* are formed on inner portions of inclined portions 57*a* and 57*b* provided in the front end portions of the upper elastic plate 50A and the lower plate 50B, respectively. The angle a of the inclined portion 57*a* of the upper elastic plate 50A may range from 43° to 47°. The angle b of the cutting blade 51*a* formed in the inclined portion 57*a* may range from 28° to 32°. In a corresponding manner, the angle c of the cutting blade 51*b* formed in the inclined portion 57*b* of the lower plate 50B may range from 28° to 32°.

When the angles are beyond these ranges, it is difficult to machine the cutting blades 51*a* and 51*b* in the upper elastic plate 50A and the lower plate 50B. In an operation of pressing the lever 70, the cutting performance may be lowered or an excessive amount of force needs to be applied.

The distance x between the cutting blade 51*a* of the upper elastic plate 50A and the cutting blade 51*b* of the lower plate 50B may have a value ranging from 0.03 mm to 0.07 mm. When the distance x is greater than this range, during the cutting of a fingernail, there may be a sensation that the fingernail is bent or the cutting performance may be lowered to some extent. In addition, when the angle of the cutting blade is greater, cutting force may be increased so that the upper blade may shove and protrude more than the lower blade. When the angle of the cutting blade is smaller, the cutting performance and the sensation of cutting may be satisfactory. However, durability may be significantly lowered, since the sharp blades may be damaged while the upper blade is shoving and rubbing against the lower blades.

In the lever 70, a stepped portion 73*a* and a curved portion 73*b* may be continuously formed. Fine grooves 74 may be machined in the surface of the curved portion 73*b* to provide the convenience of use to users. The supporting projection 71*b* may be provided on the rear end of the supporting portion 71*a* and engageable with the upper elastic plate 50A in order to provide a lever effect when pressing force is applied to the lever 70.

In addition, an abrasive member 75 may be buried in the bottom surface of the stepped portion 73*a* of the lever 70 in order to facilitate finishing after fingernails or toenails are cut. Although not shown, in a situation in which the section S3 in which the upper elastic plate 50A is stacked on the lower plate 50B is fabricated integrally, the same may be applied.

According to the above-described configuration, as illustrated in FIGS. 7*a* to 7*c*, in a position in which the cutting blades 51*a* and 51*b* of the upper elastic plate 50A and the lower plate 50B are spread, a user may cut fingernails or toenails to proper lengths by pressing the lever 70.

Here, since the thickness-reduced portion 54 is defined by the concave portion 53 provided in the inclined portion of the upper elastic plate 50A, it is possible to cut fingernails by pressing the lever 70 with only a small amount of force. The cutting blade 51*a* of the upper elastic plate 50A and the cutting blade 51*b* of the lower plate 50B are brought into engagement with each other using the lever 70. Due to the distance x between the cutting blades 51*a* and 51*b*, the cutting blade 51*a* of the upper elastic plate 50A remains in a position in which the cutting blade 51*a* is rearward of the cutting blade 51*b* of the lower plate 50B.

Accordingly, a phenomenon in which the cutting blade 51*a* of the upper elastic plate 50A protrudes more forward than the cutting blade 51*b* of the lower plate 50B may be reliably prevented, thereby preventing the tips of fingernails from being cut roughly.

As described above, the concave portion 53 of the upper elastic plate 50A is located in the inclined portion forward of the section S3 in which the upper elastic plate 50A is stacked on the lower plate 50B, such that the function of the nail clipper may be activated by pressing the lever 70 with only a small amount of force.

That is, the upper elastic plate 50A and the lower plate 50B need to be thick so as not to be bent and the angles of the cutting blades thereof need to be as small as possible in order to provide excellent cutting performance by pressing the lever 70 with a small amount of force. However, the thicker the plates, the greater the amount of force must be applied to the lever 70.

In consideration of these features, the concave portion 53 is formed in the inclined portion, forwardly spaced apart from the section S3 in which the upper elastic plate 50A is stacked on the lower plate 50B, such that the lever 70 may be very smoothly operated.

In addition, when the cutting blade 51*a* of the upper elastic plate 50A and the cutting blade 51*b* of the lower plate 50B are brought into engagement with each other, the cutting blade 51*a* is located rearward of the cutting blade 51*b*. Accordingly, a phenomenon in which sharp blades are damaged by being pressed against each other as in the related art may be prevented, and nails may be cleanly cut, thereby significantly improving cutting performance.

Furthermore, since the head 62 of the support pin 60 is buried in the bottom surface of the lower plate 50B, an aesthetic appearance may be achieved. In addition, since the lower plate 50B is coupled to the upper elastic plate 50A by spot welding, in a position opposite to the cutting blades 51*a* and 51*b*, the fabrication of the nail clipper may be facilitated.

The technical objective of the present disclosure is realized by the technical configurations described above. Although the specific embodiments of the present disclosure have been described for illustrative purposes, those skilled in the art will appreciate that various modifications, additions, and substitutions are possible, without departing from the scope and spirit of the present disclosure as disclosed in the accompanying claims and the equivalents thereof

What is claimed is:

1. A nail clipper comprising:

a body comprising an upper elastic plate (50A) and a lower plate (50B) respectively having cutting blades (51*a* and 51*b*) in front ends thereof and holes (52*a* and 52*b*) in positions adjacent to the cutting blades, wherein the upper elastic plate and the lower plate are arranged in a top-bottom direction, and the cutting blades face each other while being spread from each other;

a lever (70) comprising a supporting portion (71*a*) having a coupling hole (72); and a support pin (60) fitted into the holes (52*a* and 52*b*) of the upper elastic plate and the lower plate, with a catching protrusion (61) thereof being fitted to the coupling hole (72) of the lever (70), thereby coupling the body and the lever, wherein, in a section (S3) opposite to the cutting blades (51*a* and 51*b*) of the upper elastic plate (50A) and the lower plate (50B), a portion of the upper elastic plate is stacked on a portion of the lower plate, and a concave portion (53) is provided in a bottom surface of the upper elastic plate in a position forward of the section (S3) and the concave portion (53) forms a thickness-reduced portion (54) in the upper elastic plate (50A), when the cutting blade (51*a*) of the upper elastic plate (50A) and the cutting blade (51*b*) of the lower plate (50B) are brought into engagement with each other, the cutting blade of the upper elastic plate is located rearward of the cutting blade of the lower plate with a distance (x), and a stepped portion (58*a*, 58*b*) is provided in an inner portion of an inclined portion (57*a*, 57*b*) of the front end of each of the upper elastic plate (50A) and the lower plate (50B) wherein a slot (55*a*) is provided on one side of a surface of the upper elastic plate, and fine grooves (55*b*) are provided on an opposite side of the surface of the upper elastic plate, wherein an angle (b, c) of the cutting blade (51*a*, 51*b*) formed in the inclined portion (57*a*, 57*b*) of each of the upper elastic plate (50A) and the lower plate (50B) ranges from 28° to 32°, and when the cutting blades are brought into engagement with each other, the distance (x) between the cutting blades ranges from 0.03 mm to 0.07 mm.

2. The nail clipper of claim 1, wherein the lever (70) comprises a stepped portion (73*a*) and a curved portion (73*b*) which are continuous, fine grooves (74) are machined in a surface of the lever, and a supporting projection (71*b*) is provided on a rear end of the supporting portion (71*a*) and engageable with the upper elastic plate (50A).

3. The nail clipper of claim 2, wherein an abrasive member (75) is buried in a bottom surface of the stepped portion (73*a*) of the lever (70).

* * * * *